US005088201A

United States Patent [19]

Van Manen

[11] Patent Number: 5,088,201

[45] Date of Patent: Feb. 18, 1992

[54] SPAGHETTI CUTTING DEVICE

[76] Inventor: John Van Manen, 51331 Range Road, #224, Sherwood Park, AB, Canada, T8C-1H3

[21] Appl. No.: 666,599

[22] Filed: Mar. 8, 1991

[51] Int. Cl.[5] ..... B26B 3/04

[52] U.S. Cl. ..... 30/305; 30/137; 30/148; 30/315

[58] Field of Search ..... 30/315, 304, 305, 322, 30/123, 137, 148, 299, 114, 312

[56] References Cited

U.S. PATENT DOCUMENTS

| | | | |
|---|---|---|---|
| D. 47,697 | 8/1915 | Korpa | 30/299 X |
| D. 248,271 | 6/1978 | McGee, III | 30/114 X |
| 268,575 | 12/1882 | Tolley | 30/315 X |
| 756,356 | 4/1904 | Gunn | 30/304 |
| 1,531,161 | 3/1925 | Toomey | 30/305 X |
| 1,769,525 | 7/1930 | Maness | 30/304 |
| 1,838,752 | 12/1931 | Elfstedt | 30/304 X |
| 3,611,849 | 10/1971 | Domonkos | 30/316 X |
| 4,625,404 | 12/1986 | Valente et al. | 30/114 |

*Primary Examiner*—Hien H. Phan
*Assistant Examiner*—Raymond D. Woods
*Attorney, Agent, or Firm*—H. Jay Spiegel

[57] ABSTRACT

A spaghetti cutting device includes a pair of cutting edges spaced apart by a shorter cutting edge therewith, the cutting edges being configured to cut the strands of spaghetti extending outwardly from the sides and ends of the tines of a fork. The cutting edges are spaced apart in such a manner that any spaghetti strands wrapped around the fork are left intact for consumption. The spaghetti cutting device includes a handle to facilitate using the device.

7 Claims, 1 Drawing Sheet

SPAGHETTI CUTTING DEVICE

BACKGROUND OF THE INVENTION

The present invention relates to a spaghetti cutting device. The spaghetti cutting device is designed to be used in combination with a fork having spaghetti strands rolled thereabout. The spaghetti cutting device is designed to cut the strands of spaghetti extending outwardly from the sides and the ends of the tines of the fork.

In the prior art, cutting devices having cutting blades in various configurations are known. U.S. Pat. No. 57,888 to Gans discloses a cutting device for husking corn with U.S. Pat. No. 2,364,250 to Stokes disclosing an eel knife having a first horizontal cutting blade and a second curved cutting blade therewith. U.S. Pat. No. 3,111,995 to Dahl discloses another cutting device having a plurality of differently configured cutting elements. However, Applicant is unaware of any prior art, including the above-mentioned United States Patents, that teaches or fairly suggests a cutting device designed to cut strands of spaghetti off the side edges of a fork.

SUMMARY OF THE INVENTION

The present invention relates to a spaghetti cutting device. The present invention includes the following interrelated aspects and features:

A) In a first aspect, the inventive cutting device includes a pair of elongated side members which are connected together at one end thereof by a third shorter side member.

B) The handle attaches to the pair of elongated side members, thereby keeping the top of the cutting device open and facilitating using the cutting device for its intended purpose.

C) Each of the side elongated members and third shorter side member have on a terminating edge thereof a cutting portion which is designed to cut strands of spaghetti from the sides and ends of the tines of a fork. The elongated side members are spaced from each other in such a manner that, when the cutting action is performed, the cutting edges of the sides are spaced from the edges of the fork such that only spaghetti strands extending outwardly from the sides and ends of the tines of the fork are cut and any spaghetti strands that may be wrapped around the fork are left intact.

Accordingly, it is a first object of the present invention to provide an improved spaghetti cutting device.

It is a further object of the present invention to provide a spaghetti cutting device that is designed to be used in combination with a fork that has a plurality of spaghetti strands wrapped thereabout.

It is a still further object of the present invention to provide a spaghetti cutting fork that is designed to remove any spaghetti strands extending outwardly from the sides and ends of the tines of a fork while leaving spaghetti strands wrapped around the fork intact.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
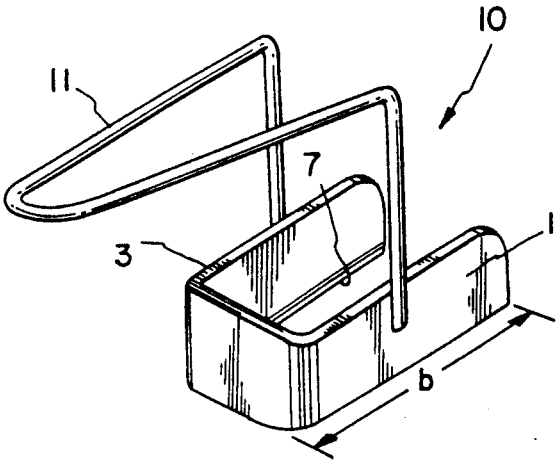
FIG. 1 shows a perspective view of the inventive spaghetti cutting device.
Figure 2:
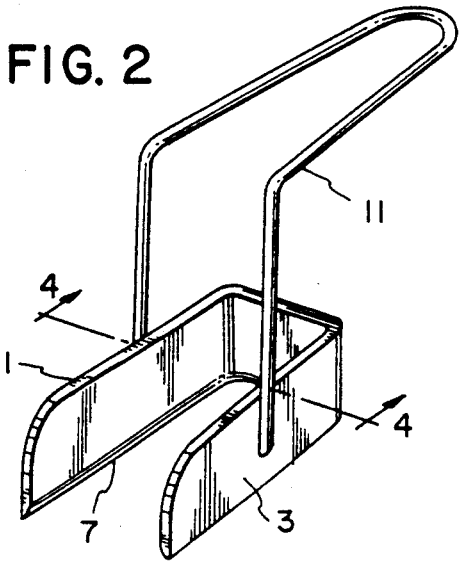
FIG. 2 shows a further perspective view of the present invention.

With reference to FIGS. 1 and 2 firstly, the improved spaghetti cutting device is generally designated by the reference numeral 10 and is seen to include a first elongated side member 1, a second elongated side member 3 and an end member 9 connecting the side members 1 and 3 together, which end member is designed to maintain the separation between the side members 1 and 3 during use.

The side members 1 and 3 also have a handle portion 11 attached thereto which facilitates utilizing the spaghetti cutter in its intended manner. As shown in particularly in FIGS. 1 and 2, the handle portion 11 includes two upright legs, with each of these legs being attached to one of the first members 1 or 3, with these legs extending away from each respective first member generally perpendicularly with respect to the cutting edge 7. These legs are interconnected by a generally V-shaped portion which is angularly related with respect to the upright legs as shown in FIGS. 1 and 2. Of course, other types of handles may be utilized in place of the handle 11 depicted in FIG. 1.

Figure 3:
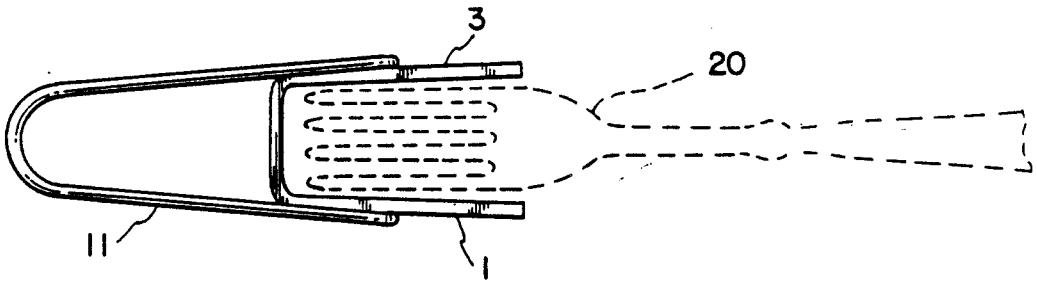
FIG. 3 shows a top view of the invention with an associated fork shown in phantom.
Figure 4:
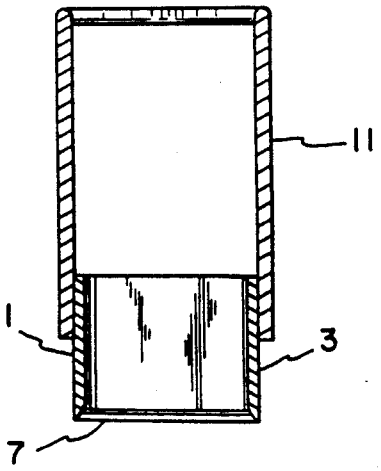
FIG. 4 shows a cross-sectional view along the line 4—4 of FIG. 2.

With reference to FIG. 4, the side members 1 and 3 and end member 9 include a cutting edge 7 thereon which extends continuously from the side member 1 to the end member 9 to the side member 3. The side members 1 and 3 are spaced apart by the distance a as depicted in FIG. 4 to permit the cutting edge 7 to cut off any elongated spaghetti strands extending outwardly from the fork 20. The spacing a between the elongated side members 1 and 3 is such that the cutting edge 7 on them does not cut the spaghetti too near the edges of the fork 20 (FIG. 3) such that any strands of spaghetti that are wrapped around the fork 20 would be cut, thereby causing the strands below the fork to fall therefrom. The portion of the cutting edge 7 on the end member 9, of course, cuts any spaghetti strands extending beyond the ends of the tines of the fork 20. The spacing b, as shown in FIG. 1, should approximate the length of the eating portion of the fork.

The inventive cutting device may be made out of any material with a preferred material being a plastic or metal. Preferred dimensions include a 2 centimeter height, 3 centimeter width and 6 centimeter length. It should be understood that the dimensions may vary as well as the shape of the side and top members as long as the side members maintain the proper spacing for a given fork size.

As such, an invention has been disclosed in terms of a preferred embodiment thereof which fulfills each and every one of the objects of the invention as set forth hereinabove and provides a new and improved spaghetti cutting device of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. A device for cutting spaghetti off of a fork comprising:

(a) a pair of first members, each first member having a cutting edge along a bottom edge thereof;

(b) a second member, said second member connecting said pair of first members together such that said pair of first members are parallel and spaced apart a distance slightly greater than the width of the tines of said fork, said second member having a cutting edge thereon connected with each first member cutting edge to form a continuous generally U-shaped cutting edge; and (c) a handle including two upright legs, each of said legs being attached to one of said first members and extending away therefrom in a direction generally perpendicular to a cutting edge thereof, said legs being interconnected by a generally V-shaped portion, said generally V-shaped portion being interconnected with said legs at respective bent connection locations;

(d) whereby said device is adapted to be placed over said fork having spaghetti wrapped therearound such that said cutting edges cut off any spaghetti strands extending outwardly from the sides and end of the fork.

2. The invention of claim 1, wherein said handle is attached to said pair of first members with each leg thereof being fastened to an outside face of a respective first member.

3. The invention of claim 2, wherein said device is metal.

4. The invention of claim 1, wherein said device is plastic.

5. The invention of claim 1, wherein each of said first members is elongated and said second member is shorter than said first members.

6. The invention of claim 5, wherein each of said first members has a length approximately equal to a length of said tines of said fork.

7. The invention of claim 6, wherein said second member has a length slightly greater than a width of said fork.

* * * * *